US009701322B2

(12) United States Patent
Kienberger et al.

(10) Patent No.: US 9,701,322 B2
(45) Date of Patent: Jul. 11, 2017

(54) RAIL VEHICLE HAVING TILTING TECHNOLOGY

(71) Applicant: SIEMENS AG OESTERREICH, Vienna (AT)

(72) Inventors: Andreas Kienberger, Graz (AT); Martin Teichmann, Graz (AT)

(73) Assignee: Siemens AG Oesterreich, Vienna (AT)

( * ) Notice: Subject to any disclaimer, the term of this patent is extended or adjusted under 35 U.S.C. 154(b) by 2 days.

(21) Appl. No.: 14/762,553

(22) PCT Filed: Jan. 16, 2014

(86) PCT No.: PCT/EP2014/050806
§ 371 (c)(1),
(2) Date: Jul. 22, 2015

(87) PCT Pub. No.: WO2014/114553
PCT Pub. Date: Jul. 31, 2014

(65) Prior Publication Data

US 2015/0367868 A1 Dec. 24, 2015

(30) Foreign Application Priority Data

Jan. 22, 2013 (AT) ..... A 50034/2013

(51) Int. Cl.

| | |
|---|---|
| ***B61F 5/40*** | (2006.01) |
| ***B61F 5/44*** | (2006.01) |
| ***B61F 5/22*** | (2006.01) |
| ***B61D 1/00*** | (2006.01) |

(52) U.S. Cl.
CPC ..... *B61F 5/44* (2013.01); *B61D 1/00* (2013.01); *B61F 5/22* (2013.01)

(58) Field of Classification Search
CPC ..... B61F 5/44; B61F 5/22; B61F 5/24; B61F 5/245; B61F 5/38; B61D 1/00
See application file for complete search history.

(56) References Cited

U.S. PATENT DOCUMENTS

| | | | | |
|---|---|---|---|---|
| 3,628,465 | A * | 12/1971 | Dobson | B61F 5/142 105/164 |
| 5,222,440 | A * | 6/1993 | Schneider | B61F 5/24 105/167 |
| 5,351,624 | A * | 10/1994 | Ahlborn | B61F 5/127 105/185 |
| 2002/0035947 | A1* | 3/2002 | Sebata | B61F 5/22 105/199.2 |

(Continued)

FOREIGN PATENT DOCUMENTS

| | | | |
|---|---|---|---|
| AU | 2001100012 | A4 | 8/2001 |
| DE | 4423636 | A1 | 1/1996 |

(Continued)

*Primary Examiner* — Jason C Smith
(74) *Attorney, Agent, or Firm* — Laurence Greenberg; Werner Stemer; Ralph Locher

(57) ABSTRACT

A rail vehicle having tilting technology includes a car body supported on at least two chassis. At least one of the chassis is connected to the car body by an active tilting technology system and at least one additional chassis is connected to the car body by a passive tilting technology system. The tilt of the car body is applied exclusively by the active tilting technology system. Thus, uncontrolled twisting and loading of the car body is avoided.

7 Claims, 3 Drawing Sheets

(56) References Cited

U.S. PATENT DOCUMENTS

| | | | | |
|---|---|---|---|---|
| 2004/0016361 | A1* | 1/2004 | Teichmann | B61F 5/148 105/164 |
| 2006/0117986 | A1* | 6/2006 | Schneider | B61F 5/22 105/199.2 |
| 2007/0137515 | A1* | 6/2007 | Schneider | B61F 5/10 105/182.1 |
| 2012/0118194 | A1* | 5/2012 | Schneider | B61F 5/24 105/171 |
| 2012/0180693 | A1* | 7/2012 | Haas | B61F 5/22 105/206.1 |
| 2012/0227617 | A1* | 9/2012 | Schneider | B60G 99/002 105/199.2 |
| 2013/0018535 | A1* | 1/2013 | Schneider | B61K 9/02 701/19 |
| 2016/0001793 | A1* | 1/2016 | Haigermoser | B61C 9/50 105/79 |
| 2016/0257318 | A1* | 9/2016 | Kuter | B61F 3/02 |

FOREIGN PATENT DOCUMENTS

| | | | |
|---|---|---|---|
| DE | 4446002 | A1 | 1/1996 |
| DE | 4444540 | A1 | 11/1996 |
| DE | 19522378 | A1 | 1/1997 |
| DE | 10316497 | A1 | 1/2005 |
| EP | 0287821 | A2 | 10/1988 |
| EP | 0619212 | A1 | 10/1994 |
| JP | 2002154432 | A | 5/2002 |
| WO | 9003906 | A1 | 4/1990 |

* cited by examiner

RAIL VEHICLE HAVING TILTING TECHNOLOGY

BACKGROUND OF THE INVENTION

Field of the Invention

The invention relates to a rail vehicle having tilting technology.

When a rail vehicle travels through a curve, the centrifugal force produces a moment whereby the car tilts in the direction of the outside of the curve. As a result of said tilt, the system of coordinates also rotates for the passenger in the car body, and part of the gravitational acceleration now works as lateral acceleration, this being a particularly unpleasant sensation.

In particular, in the case of high-speed travel through a curve with high transversal acceleration at the wheelset, the values acceptable to the passenger are significantly exceeded in the absence of additional measures.

The prior art discloses so-called tilting technology, a curve-dependent car body control system, in which the car bodies of a railway train can be tilted towards the inside of the curve, thereby reducing the lateral acceleration that is experienced.

It is therefore possible to travel faster through curves ("high-speed travel through a curve") or to make the travel through a curve more pleasant for the passenger ("comfort tilting").

Tilting technology systems disclosed in the prior art, e.g. as described in EP 0619212, allow a curve tilt of up to 8°. This allows the speed in curves to be increased by up to 30% without any reduction in travelling comfort through increased lateral acceleration.

Tilting technology systems can essentially be embodied as passive systems or active systems.

In the case of passive tilting technology, the car bodies are usually suspended above their center of gravity on raised extensions of the chassis frame. They therefore swing outwards in the lower region and inwards in the upper region as a result of the centrifugal force. The swinging is cushioned by damping elements. The angle of tilt is restricted to 3.5°. This means that the increase in speed when travelling through curves is also significantly less than in the case of active systems, and passive tilting technology is therefore used primarily to improve comfort.

In the case of active tilting technology, the displacement of the car bodies is effected by means of actuators, which are embodied as hydraulic actuating cylinders or as electrical servomechanisms. In this case, it must be ensured that the car bodies are automatically returned from a tilted state to a horizontal basic state (ready-to-run position) if the actuators fail. This is achieved by designing the chassis in relation to the center of gravity and the rotational axis of the car bodies such that a corresponding righting moment becomes effective in the tilted state. It is disadvantageous in this case that powerful actuators are required for this purpose, since said actuators must act against this righting moment in the tilted state of the car bodies.

DE 103 16 497 discloses a rail vehicle having active tilting technology, wherein the car body is pivotably supported by means of rollers and roller tracks.

If the car body of a rail vehicle is supported on two or more chassis having active tilting technology systems, there is a danger that the car body may be twisted and loaded in an uncontrolled manner as a result of being controlled differently by the two or more active tilting technology systems. Moreover, the twisting reduces the load on individual wheels, which can in extreme cases result in derailment when travelling through a curve. Such conventional tilting technology systems therefore require a correspondingly costly monitoring device.

BRIEF SUMMARY OF THE INVENTION

The object of the invention is to provide a tilting technology system which offers greater tolerance and simplicity with regard to the cited disadvantages.

This object is inventively achieved by a rail vehicle having tilting technology, wherein the car body is supported on at least two chassis, and wherein at least one of the chassis is connected to the car body via an active tilting technology system and wherein at least one further chassis is connected to the car body via a passive tilting technology system.

In this case, it is advantageous that each chassis on which the car body is supported does not have to have an active tilting technology system. If each car body has two chassis, for example, only one chassis needs to have the active tilting technology system. The tilt of the car body when the rail vehicle travels through a curve is then applied exclusively by means of the one active tilting technology system.

It is also advantageous that the active tilting technology system can be monitored easily and accurately by means of simple software. The cost of cabling for the tilting technology system is also reduced.

The at least one chassis which is connected to the car body via the passive tilting technology system preferably has an instantaneous center that is situated as close as possible to the center of gravity of the car body, preferably in the center of gravity of the car body, in every tilted state of the car body.

An instantaneous center is understood to be the axis of rotation of the car body at an angular instant. If the instantaneous center of the passive tilting technology system lies in the center of gravity of the car body in every tilted state, no righting moment occurs. If the instantaneous center of the passive tilting technology system lies as close as possible to the center of gravity of the car body in every tilted state, only a very limited righting moment occurs.

The instantaneous center preferably lies in the center of gravity of the car body. The tilted state of the car body can then be returned to the horizontal basic state only by means of external dynamic effect, i.e. by means of the active tilting technology system according to the invention. No righting moment is produced by the force of gravity alone in this case. The description of the position of the instantaneous center and the center of gravity assumes a view which is normal relative to a longitudinal axis of the car body.

The tilt of the car body is applied solely by that chassis which is connected to the car body via the active tilting technology system.

This advantageously avoids uncontrolled twisting and loading of the car body, which can occur if every chassis is equipped with an active tilting technology system. A safety risk which occurs as a result of such twisting, owing to the load on individual wheels being reduced when travelling through a curve, is therefore avoided.

In an advantageous embodiment variant, the at least one chassis which is connected to the car body via the active tilting technology system has, in every tilted state of the car body, an instantaneous center that lies next to the line of action of the force of gravity through the center of gravity of the car body.

If the instantaneous center of the active tilting technology system lies next to the line of action of the force of gravity through the center of gravity of the car body in every tilted state of the car body, a righting moment occurs.

This ensures that, if the active tilting technology system fails, the car body is automatically moved from the tilted state into the horizontal basic state by the action of the force of gravity.

The description of the position of the instantaneous center and the center of gravity assumes a view which is normal relative to a longitudinal axis of the car body.

In an advantageous embodiment, the car body is pivotably supported on the at least one further chassis having a passive tilting technology system by means of rollers running in roller tracks.

According to a further advantageous embodiment, the car body is pivotably connected to the at least one chassis having an active tilting technology system by means of a pendulum mechanism.

The car body may also be pivotably supported, by means of rollers running in roller tracks, on all chassis having a passive tilting technology system and on all chassis having an active tilting technology system.

Such supports have the advantage of exhibiting very little rolling resistance. In comparison with the prior art, it is therefore possible to use smaller, less powerful and more economical actuators on the chassis having the active tilting technology system, said actuators moving the car body from the tilted state to the horizontal basic state and vice versa.

BRIEF DESCRIPTION OF THE SEVERAL VIEWS OF THE DRAWING

The invention is explained in greater detail with reference to exemplary schematic figures in which.

DESCRIPTION OF THE INVENTION

Figure 1:
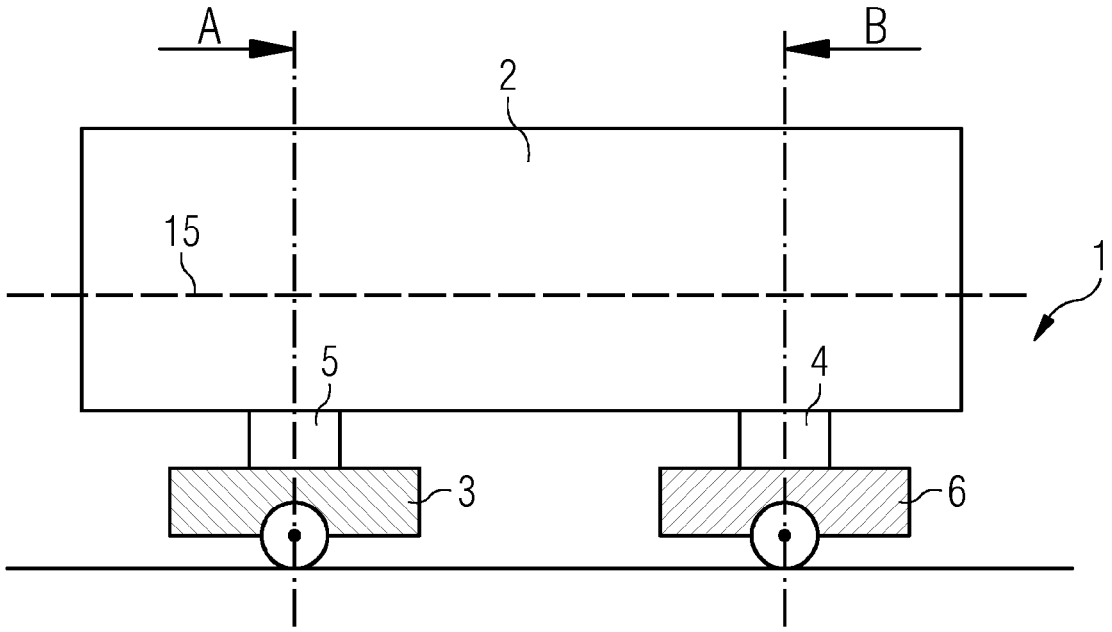
FIG. 1 shows an inventive rail vehicle having tilting technology.

The rail vehicle 1 illustrated in FIG. 1 has a first chassis 3 and a second chassis 6. A car body 2 having a longitudinal axis 15 is supported on the chassis 3, 6. The second chassis 6 is connected to the car body 2 via an active tilting technology system 4, and the first chassis 3 is connected to the car body 2 via a passive tilting technology system 5. When the rail vehicle 1 travels through a curve, the tilt of the car body 2 is applied exclusively by means of the active tilting technology system 4. The chassis 3 having the passive tilting technology system 5 follows the movements of the active tilting technology system 4, but does not include any devices or actuators for the purpose of actively assisting a tilt of the car body 2.

Figure 2A:
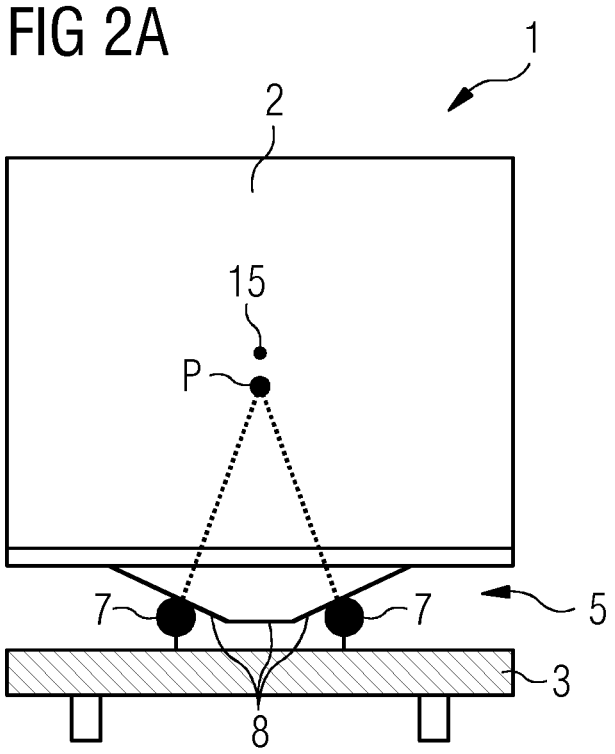
FIG. 2*a* shows a view of an inventive rail vehicle in the section A.

FIG. 2*a* illustrates the rail vehicle 1 in the section A. The car body 2 is pivotably supported, by means of rollers 7 running in roller tracks 8, on the first chassis 3 having the passive tilting technology system 5. The car body 2 can pivot about the instantaneous center P. The chassis 3 does not include any devices for actively assisting the tilt of the car body 2. The rail vehicle 1 is illustrated in an untilted state, i.e. the horizontal basic state. The roller tracks 8 are tilted in different directions, such that their extensions intersect at a point in the same way as the limbs of a V. The rollers 7 and the roller tracks 8 are so arranged as to be essentially symmetrical relative to the longitudinal axis 15 or to a vertical plane through the longitudinal axis 15 of the car body 2.

Figure 2B:
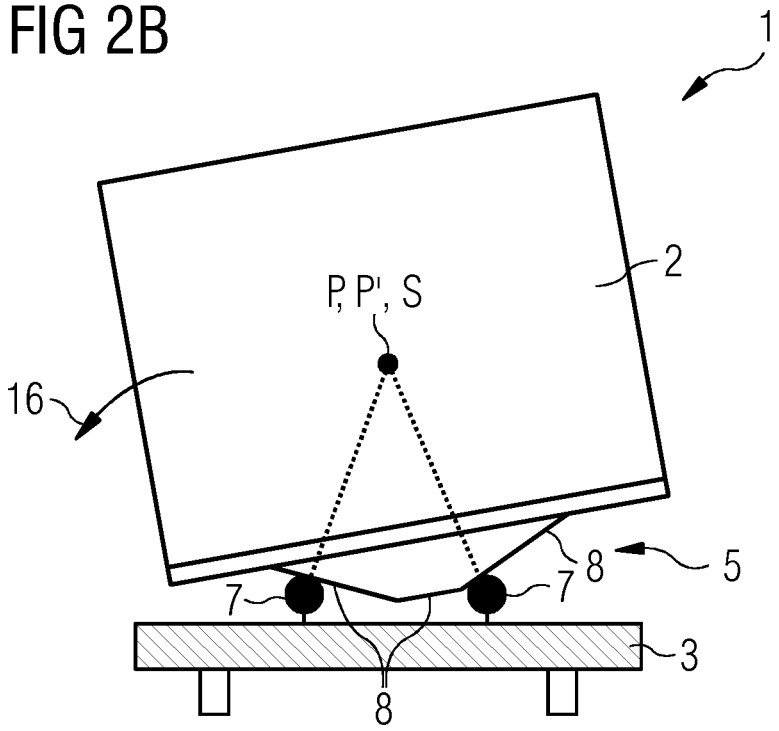
FIG. 2*b* shows a view of an inventive rail vehicle having a tilted car body in the section A.

FIG. 2*b* shows the rail vehicle 1 having a tilted car body 2, again in the section A. The car body 2 is pivotably supported, by means of rollers 7 running in roller tracks 8, on the first chassis 3 having the passive tilting technology system 5. The car body 2 can pivot about the instantaneous center P. In comparison with the illustration in FIG. 2*a*, the car body 2 is tilted in the first tilt direction 16, and is therefore in the tilted state. The position of the instantaneous center P does not change during the tilting process of the car body 2—its position therefore coincides with the instantaneous center P' in every tilted state of the car body 2. The instantaneous center P' is the axis of rotation of the car body 2 in the tilted state at an angular instant. The passive tilting technology system 5 has an instantaneous center P which is preferably situated in the center of gravity S of the car body 2 in every tilted state of the car body 2. In this case, the force of gravity does not exert any righting moment which returns the car body 2 back to the horizontal basic state due to the force of gravity. The tilted state of the car body 2 can only be returned to the basic state again by means of external dynamic effect.

The tilt of the car body 2 is applied solely by the second chassis 6 having the active tilting technology system 4.

Figure 3A:
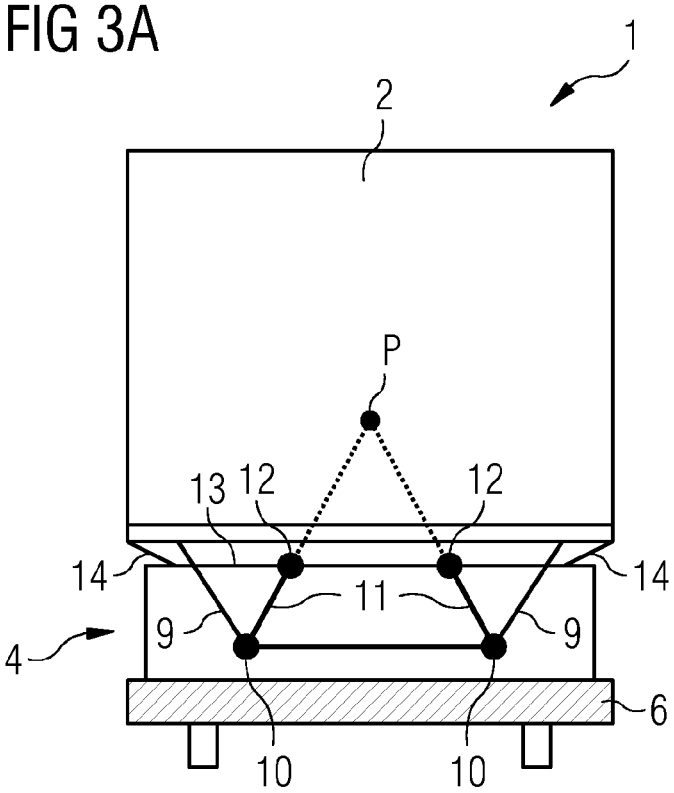
FIG. 3*a* shows a view of an inventive rail vehicle in the section B.

FIG. 3*a* illustrates the rail vehicle 1 in the section B. The second chassis 6 is connected to the car body 2 via the active tilting technology system 4. The active tilting technology system 4 is designed as a pendulum mechanism in this embodiment variant. The pendulum mechanism comprises two carrier elements 9, which are connected to the floor of the car body 2. The carrier elements 9 have first joints 10, which provide a rotatably mobile connection to pendulum elements 11. At their ends which are opposite to the first joints 10, the pendulum elements 11 are connected in a rotatably mobile manner via second joints 12 to a cross-member 13. The cross-member 13 is connected to the second chassis 6. Either the carrier elements 9 can be rigidly connected to the car body 2 or the cross-member 13 can be rigidly connected to the second chassis 6. Actuators 14 are provided between the cross-member 13 and the carrier elements 9, and effect the tilting of the car body 2 about the instantaneous center P.

Figure 3B:
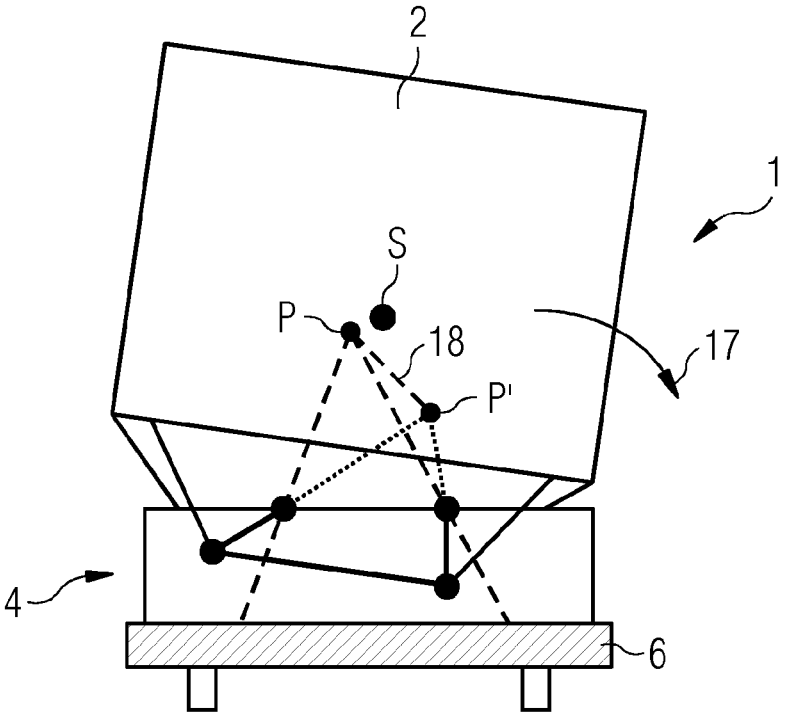
FIG. 3*b* shows a view of an inventive rail vehicle having a tilted car body in the section B.

FIG. 3*b* shows the rail vehicle 1 in the section B, now in a tilted state. The second chassis 6 is connected to the car body 2 via the active tilting technology system 4. The car body 2 is tilted in the second tilt direction 17, and is therefore in the tilted state. During the tilting process of the car body 2 in the second tilt direction 17, the instantaneous center P moves from P to P' on a curve 18. In every tilted state of the car body 2, the instantaneous center P' of the active tilting technology system 4 lies next to the line of action of the force of gravity through the center of gravity S of the car body 2. A righting moment which is conducive to the horizontal basic state of the car body 2 therefore occurs in every tilted state.

This ensures that, if the active tilting technology system 4 fails, the car body 2 is automatically moved from the tilted state into the horizontal basic state due to the effect of the force of gravity.

The car body 2 may also be pivotably supported, by means of rollers 7 running in roller tracks 8, on all chassis 3, 6 having a passive tilting technology system 5 and on all chassis 3, 6 having an active tilting technology system 4.

Such supports have the advantage of exhibiting very little rolling resistance. In comparison with the prior art, it is therefore possible to use smaller, less powerful and more economical actuators 14 on the chassis 6 having the active tilting technology system 4, said actuators 14 moving the car body 2 from the tilted state to the horizontal basic state and vice versa.

Using the inventive rail vehicle 1, the tilt of the car body 2 is applied exclusively by means of the active tilting technology system 4. This avoids uncontrolled twisting and loading of the car body 2.

The inventive solution is not restricted to the cited examples, and other embodiments are also possible.

LIST OF REFERENCE SIGNS

1 Rail vehicle
2 Car body
3 First chassis
4 Active tilting technology system
5 Passive tilting technology system
6 Second chassis
7 Rollers
8 Roller track
9 Carrier element
10 First joint
11 Pendulum element
12 Second joint
13 Cross-member
14 Actuator
15 Longitudinal axis
16 First tilt direction
17 Second tilt direction
P Instantaneous center in the horizontal basic state
P' Instantaneous center in the tilted state
S Center of gravity

The invention claimed is:

1. A rail vehicle having tilting technology, the rail vehicle comprising:

a car body;

at least two chassis supporting said car body;

at least one active tilting technology system each respectively connecting at least one of said chassis to said car body; and at least one passive tilting technology system each respectively connecting at least a further one of said chassis to said car body;

said at least one active tilting technology system and said at least one passive tilting technology system both being present without failure of said at least one active tilting technology system.

2. The rail vehicle according to claim 1, wherein:

said car body has a center of gravity; and said at least one further chassis connected to said car body by said passive tilting technology system has an instantaneous center being situated as close as possible to said center of gravity of said car body in every tilted state of said car body.

3. The rail vehicle according to claim 2, wherein said instantaneous center is situated in said center of gravity of said car body.

4. The rail vehicle according to claim 1, wherein:

said car body has a center of gravity defining a line of action of the force of gravity through said center of gravity of said car body; and said at least one chassis connected to said car body by said at least one active tilting technology system has an instantaneous center lying next to said line of action in every tilted state of the car body.

5. The rail vehicle according to claim 1, which further comprises rollers running in roller tracks and pivotably supporting said car body on said at least one further chassis connected to said passive tilting technology system.

6. The rail vehicle according to claim 1, which further comprises a pendulum mechanism pivotably connecting said car body to said at least one chassis connected to said at least one active tilting technology system.

7. The rail vehicle according to claim 1, which further comprises rollers running in roller tracks and pivotably supporting said car body on all of said chassis connected to said at least one passive tilting technology system and on all of said chassis connected to said at least one active tilting technology system.

* * * * *